United States Patent [19]

Matsuda

[11] Patent Number: 4,650,036

[45] Date of Patent: Mar. 17, 1987

[54] EMERGENCY EVACUATION APPARATUS

[76] Inventor: Masako Matsuda, 1-6-5 Shinkadokawa, Uozu, Toyama, Japan

[21] Appl. No.: 726,052

[22] Filed: May 9, 1985

[51] Int. Cl.[4] ..... B66B 1/00; E04G 1/18; E04G 1/34

[52] U.S. Cl. ..... 187/27; 187/73; 187/92; 182/142; 182/152

[58] Field of Search ..... 187/8, 92, 1 R, 20, 187/27, 73, 6; 182/144, 152, 142, 223, 148; 206/600; 188/166

[56] References Cited

U.S. PATENT DOCUMENTS

| | | | |
|---|---|---|---|
| 529,462 | 11/1894 | Rank | 187/72 X |
| 1,003,050 | 9/1911 | Kenyeres | 187/92 |
| 3,978,942 | 9/1976 | Jimenez | 182/142 X |
| 4,137,996 | 2/1979 | Brown | 182/152 X |
| 4,440,261 | 4/1984 | Clark | 182/142 X |
| 4,520,900 | 6/1985 | Orgeron | 182/142 X |

FOREIGN PATENT DOCUMENTS

| | | | |
|---|---|---|---|
| 63766 | 8/1892 | Fed. Rep. of Germany | 182/142 |
| 625311 | 9/1961 | Italy | 182/142 |
| 179762 | 5/1922 | United Kingdom | 182/72 |

*Primary Examiner*—H. Grant Skaggs
*Assistant Examiner*—Gregory L. Huson
*Attorney, Agent, or Firm*—Koda and Androlia

[57] ABSTRACT

An emergency evacuation apparatus including a cage, a drum with a hoisting wire wound around it, the drum being rotatably supported above the cage, a brake cylinder formed into a single unit with the drum in a manner to rotate together with the drum, a brake lever provided with the momentum by spring to work in the direction to apply the braking effect to the brake cylinder, the brake lever being disposed to face the brake cylinder, and a brake release lever linked to the interlocking lever causes the brake lever to turn in the direction to release the brake applied to the brake cylinder.

5 Claims, 5 Drawing Figures

EMERGENCY EVACUATION APPARATUS

BACKGROUND OF THE INVENTION

1. Field of the Invention

This invention relates to an emergency evacuation apparatus, and more particularly to an evacuation apparatus used to evacuate people quickly and safely from high places which additionally can easily be used by the physically handicapped.

2. Prior Art

Emergency evacuation apparatuses generally used today in buildings for evacuating from fires, etc. include fire escape stairs, ladders, chutes, etc. However, these evacuation apparatuses are not very useful unless the person using it is healthy. In other words, they are not very useful when the physically handicapped, injured, sick, elderly, etc. must be evacuated.

SUMMARY OF THE INVENTION

Accordingly, it is a primary object of this invention to provide an evacuation apparatus which can be used by the physically handicapped or vulnerable such as the sick, injured, elderly, etc. to evacuate to a safe place.

Another object of this invention is to provide an emergency evacuation apparatus which can be used without creating a feeling of insecurity in the person using it, i.e. it is structured so that one can always put his feet on the floor of the cage.

In order to achieve the foregoing objects, the emergency evacuation apparatus of this invention is designed such that the whole body of the cage can be lowered by its weight without requiring complicated operation.

In keeping with the principles of this invention, the objects of this invention are accomplished by a unique structure for an emergency evacuation apparatus including a cage, a suspension frame fixed on the cage, a hoisting wire drum provided on the suspension frame, and a brake system. The brake system includes a brake cylinder formed into a single unit with the hoisting wire drum, a brake lever having a brake block, a spring urging the brake block onto the brake cylinder, and a brake release bar pivotally mounted on the suspension frame. The release bar is connected to a brake release lever provided in the cage so that when the release lever is actuated, one end of the brake release bar turns the brake lever so that the brake lever releases the brake block from the brake cylinder, rotating the drum to unwind the hoisting wire and lower the cage.

BRIEF DESCRIPTION OF THE DRAWINGS

The above mentioned features and objects of the present invention will be more apparent with reference to the following description taken in conjunction with the accompanying drawings wherein like reference numeral denote like elements, and in which.

DETAILED DESCRIPTION OF THE INVENTION

Figure 1:
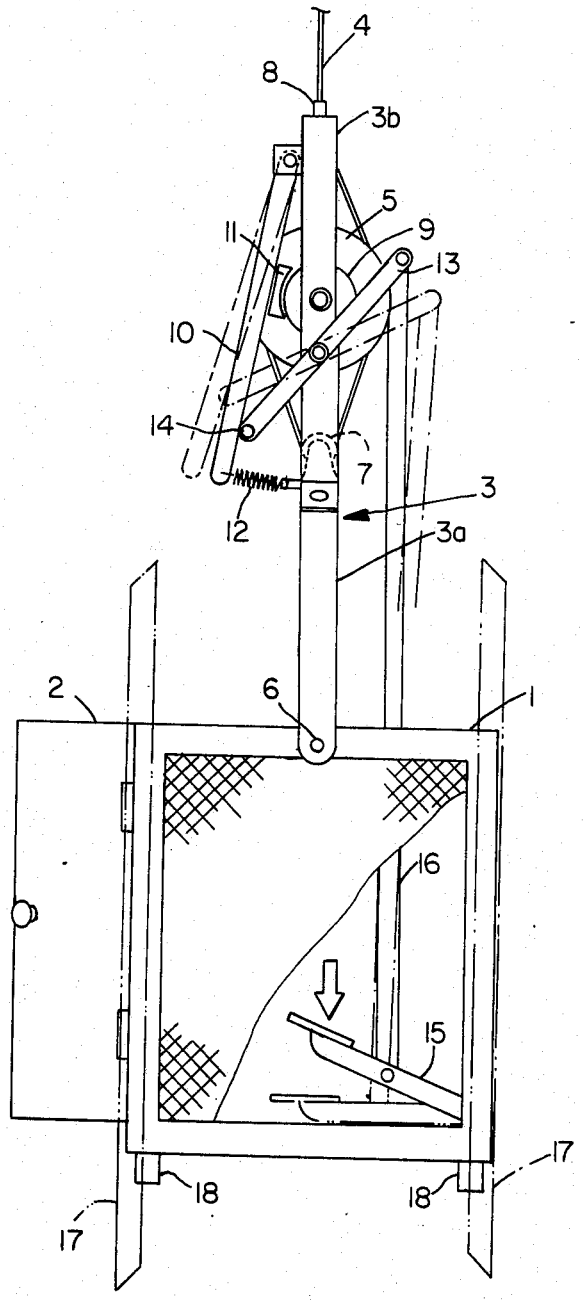
FIG. 1 is a front view showing the emergency evacuation apparatus of the present invention including a brake-release unit and a cage.

A cage 1 for an emergency evacuation apparatus is formed like a box opened at the top with the height slightly lower than the average person. Above this cage 1, a suspension frame 3 is provided, and a drum 5 with a hoisting wire 4 wound around it is mounted through a brake cylinder 9 on the frame 3 to rotate around the horizontal axis. The suspension frame 3 includes a pair of reversed U-shaped frames **3*a* and 3*b*. These two frames are coupled to each other vertically; the upper frame 3*b* is smaller than the lower frame 3*a*. Both ends of the lower frame 3*a* are swingably connected to the cage 1 by means of pins 6**.

The drum 5 is disposed within the upper frame **3*b*. The wire 4 unwound off of the drum 5 passes along a guide roller 7 disposed below the drum 5 and is led upward through a guide cylinder 8 provided at the upper end of the frame 3. The upper end of this wire 4** is anchored to a fixing member, such as a hook.

Between the drum 5 and the frame 3 is a brake mechanism including the brake cylinder 9, a brake lever 10, etc. The brake cylinder 9 is coaxial with the drum 5 to form a single body and disposed on the surface of the drum 5. The outer surface of the brake cylinder 9 is made rough.

The brake lever 10 is pivotally fixed at its upper end to the frame 3, and a brake block 11 is provided at the middle portion of the lever 10. Between the lower end of the brake lever 10 and the frame 3, a tension spring 12 is provided so that the spring 12 forces the block 11 to be in contact with the outer surface of the brake cylinder 9, thereby maintaining braking. An interlocking lever 13 is mounted pivotally at the middle portion of the frame 3, one end of the lever 13 having a push rod.

As shown in FIG. 1, when the interlocking lever 13 turns clockwise, the push rod 14 pushes the brake lever 10 up in a direction to release the brake. The numeral 15 represents a brake release lever which is held pivotally at the inside bottom of the cage 1. This release pedal 15, a pedal type lever, is linked to the end of the interlocking lever 13 through a linking rod 16. In the Figure, the numeral 17 represents guide rails and the numeral 18 represents cushions.

In the above structure, in the usual state, the brake lever 10 is pulled toward the brake cylinder 9 by the elastic force of the spring 12 and the brake block 11 is kept in contact with the brake cylinder 9. Thus, the drum 5 is braked and the veered out length of the wire 4 remains unchanged. As a result, the cage 1 and the frame 3, as a whole, are kept suspended at a given height.

When an evacuee in the cage 1 steps on the release pedal 15, one end of the interlocking lever 13 is brought down through the linking rod 16, and the interlocking lever 13 turns clockwise as shown in FIG. 1. As a result, the push rod 14 at the end of the interlocking lever 13 pushes the brake lever 10 up, thus causing the brake lever 10 to turn counterclockwise and release the brake against the elastic momentum of the spring 12. As a result, the block 11 comes off the brake cylinder 9, the braking effect is released, and the drum 5 rotates in a direction to feed the wire 4 out, causing the cage 1 to be lowered.

In the Figure, a block brake is employed as the braking mechanism for the drum 5. Otherwise, a hand brake to wind a brake band around the brake cylinder 9, an internal expansion brake to press a braking block to the inner circumferential surface of the brake cylinder 9, or a disc brake may be used. Furthermore, the brake mechanism may be provided on both ends of the drum 5 to form a double interlocking system.

In addition, the apparatus can be designed such that the cage 1 and the frame 3 may be suspended by two or more wires 4 which are designed to be fed out synchronously. It is also possible to install the brake mechanism and the drum 5 inside the cage 1 by increasing the height of the cage 1. The operation lever may be designed to be manually operated, and heat insulating material may be put around the cage 1.

As described above and seen in FIG. 1, the cage 1 is fixed swingably at the lower ends of the frame 3 by means of the pins 6 so as to be allowed to swing freely. The center of the interlocking lever 13 for interlocking the brake lever 10 is pivotally mounted on the frame 3 to turn freely in the same direction as the swinging direction of the cage 1. The push rod 14 for pushing the brake lever 10 causing the brake lever 10 to move toward the brake releasing direction is fastened to one end of the interlocking lever 13.

The release pedal 15 is provided on the bottom of the cage 1, being positioned one side of the cage, the pins 6 acting as a dividing point. The release pedal 15 is connected to the interlocking lever 13 via the linking rod 16. The linkage provided by the linking rod 16 allows the pedal 15 to make the interlocking lever 13 turn in the direction which releases the brake lever 10. Also, a door 2 is provided on the other side of the cage 1, with the pins 6 again acting as the dividing point. Therefore, when the interlocking lever 13 is turned in the direction in which the brake lever 10 is not released, the push rod 14 can come away from the brake lever 10. Accordingly, even if impact is applied to the pedal 15 side in the cage 1 when an evacuee enters the cage 1, the cage 1 swings to one side and the push rod 14 is brought away from the brake lever 10, releasing the linkage between the brake lever 10, the interlocking lever 13, the release pedal 15, and the linking rod 16. Thus, any impact cannot be transmitted to the brake-release mechanism and the brake release mechanism avoids losing its function.

Figure 2:
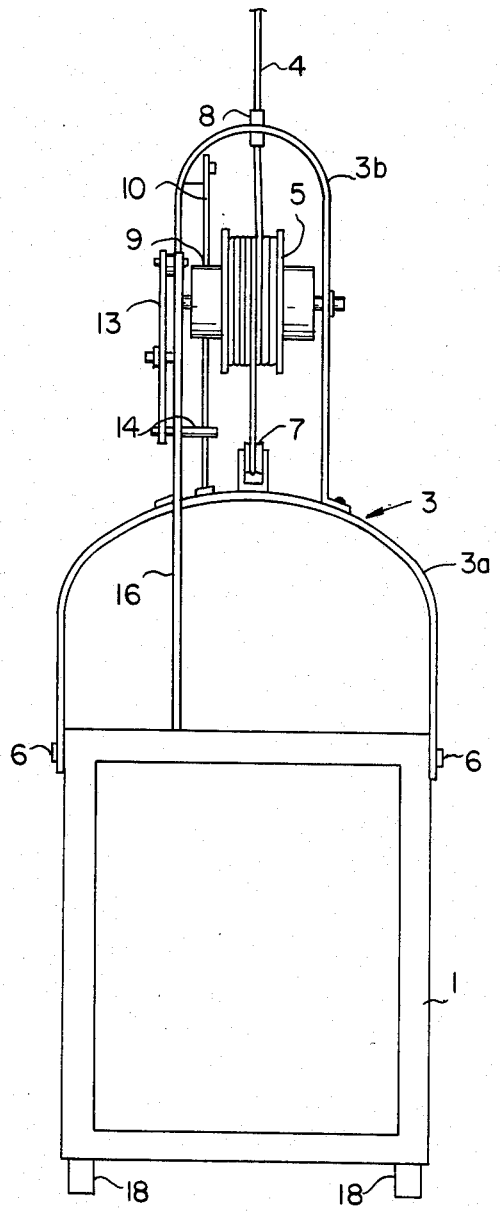
FIG. 2 is a side view thereof.
Figure 3:
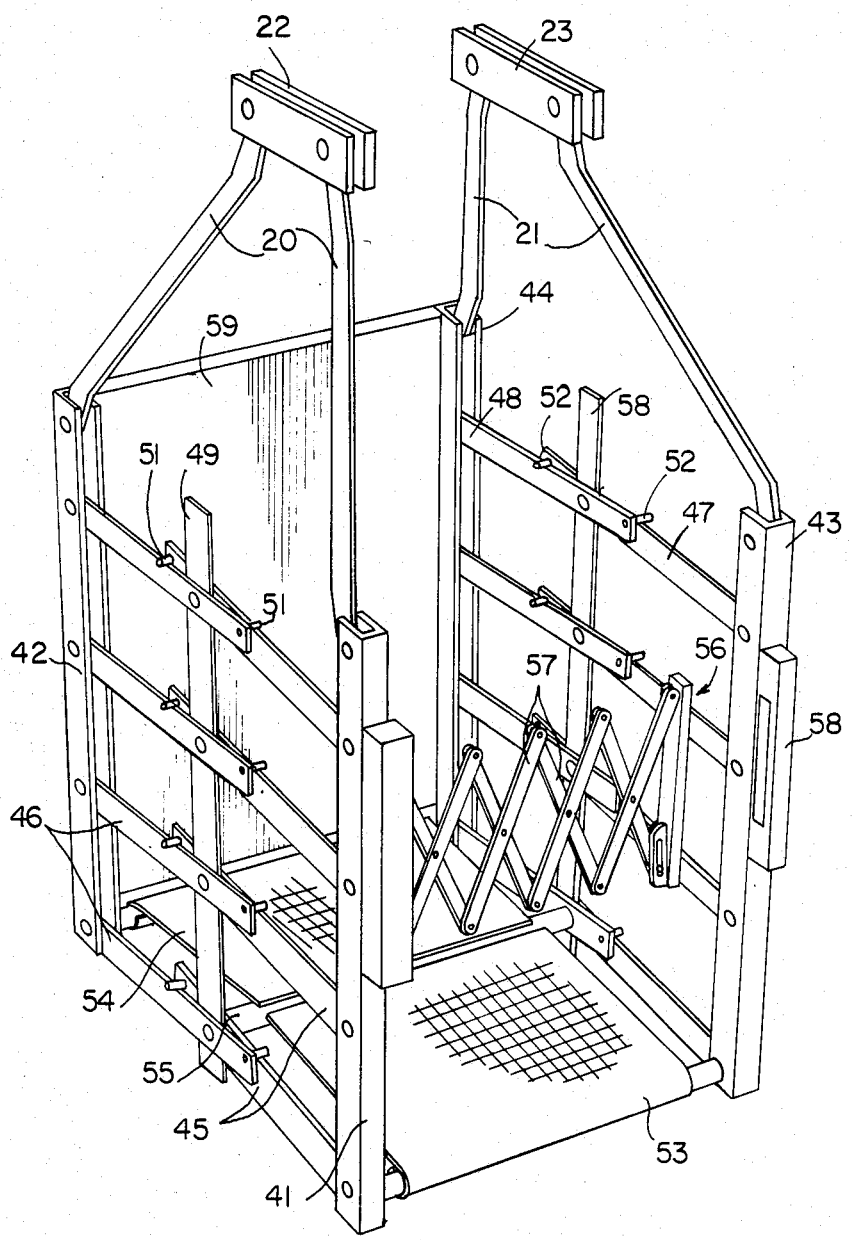
FIG. 3 is a perspective view of a collapsible cage used for the apparatus of this invention, the cage including foldable side walls and a foldable floor.
Figure 4:
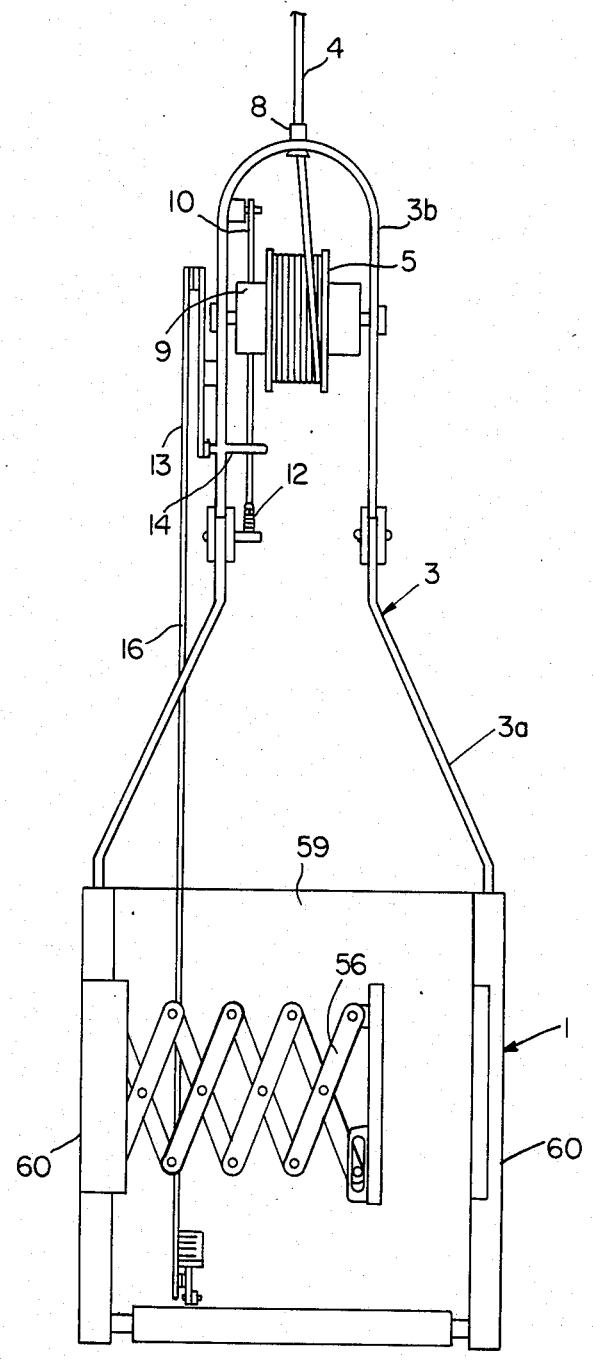
FIG. 4 is a front view of the emergency evacuation apparatus including a collapsible cage.

The cage 1 in the above described embodiment is boxshaped as shown in FIGS. 1 and 2 and is conventionally used. However, the cage 1 may also be foldable as shown in FIG. 3. Hereunder, a detailed description will be of the construction of the foldable type cage.

In the FIG. 3, the numerals 41 and 42 are front and back pillars on the left side of the cage 1, and 43 and 44 are front and back pillars on the right side. The front and back pillars are connected by collapsible side walls 60.

The side walls 60 have a link mechanism including cross pieces 45, 46, 47 and 48. Each of the side walls 60 includes several pairs of links formed by the cross pieces 45 and 46 and the cross pieces 47 and 48 which are arranged vertically. Each pair of links can be folded into an inverted V-shape. The ends of the cross pieces are fixed pivotally to the pillars. The links are arranged vertically on the vertical pieces 49 and 50, so that the links of the upper rows and lower rows can be folded in parallel to each other. On the inner side of the end of each cross piece is provided stop pins 51 and 52 and these stop pins 51 and 52 control the folding/unfolding angles of the links.

The bottom of the cage 1 includes floor members 53 and 54 which can be folded into a V-shape in the same manner as the link mechanism mentioned above. The floor member 53 at the front is held pivotally between the lower portions of the front pillars 41 and 43, while the floor member 54 at the back is held pivotally between the lower portions of the rear pillars 42 and 44. The inner ends of both floor members 53 and 54 are held pivotally on a center shaft 55 which is spanned between the vertical pieces 49 and 50. The floor members 53 and 54 are boards, but can be made of net, links, etc.

The reference numeral 56 is a foldable door. This door 56 serves to close the open space between the front pillars 41 and 43 and is formed by cross-linking a plural number of links 57. The door 56 may also be made of a board, with one end fastened to the front pillar by a hinge. A back wall 59 may be formed of wire net or fence rails. To the upper end of the respective pillars 41, 42, 43 and 44, coupling rods 20 and 21 are held pivotally, and to the upper ends of the right and left coupling rods 20 and 21, each being composed of two rods, fixing bases 22 and 23 are pivotally fixed. Reference numeral 58 denotes a receiving block for the door 56. The back wall 59 is fixed between the right and left pillars 42 and 44 at the back.

By means of the above structure, the sides walls 60 and floor board 61 of the cage 1 may be folded. Thus, the width of the front and back of the cage 1 can be reduced substantially, making it possible to store the cage 1 in a very small space. Consequently, it is convenient to keep the cage in storage when it is not in use and is easy to install in an existing building.

Figure 5:
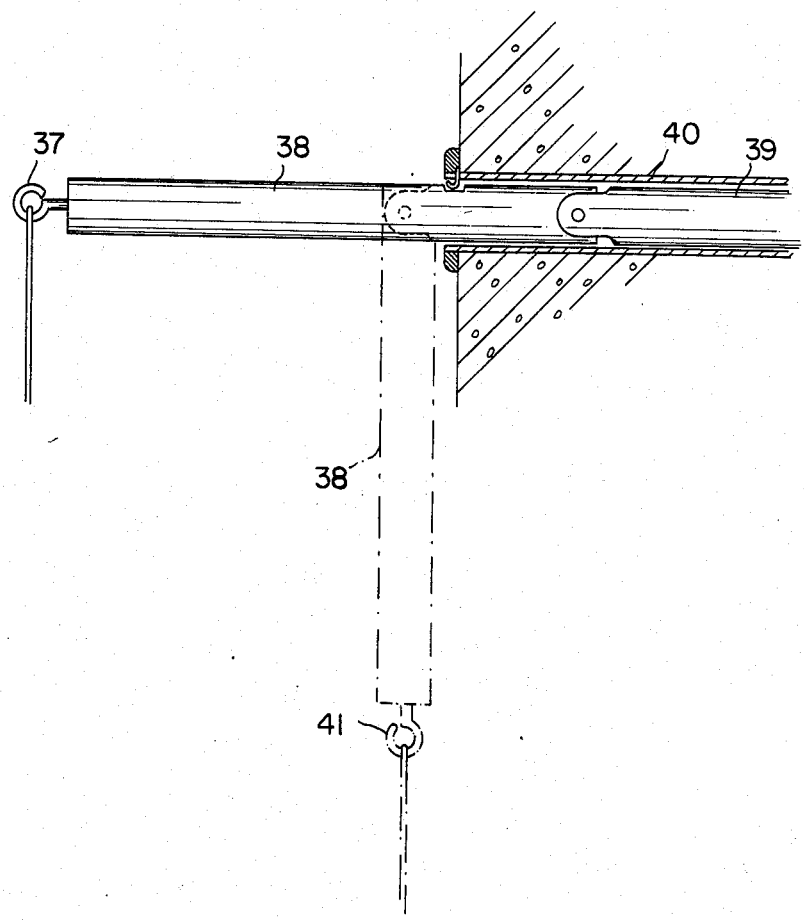
FIG. 5 is a longitudinal sectional view showing a hooking unit used in this invention in order to hang and hoist the cage.

FIG. 5 shows a hooking unit provided in the wall of a building. The wire from the drum 5 is connected to this unit. The hooking unit includes two rods 38 and 39 having identical diameters. These rods are coupled in a freely bendable manner, forming a suspension rod. This suspension rod is inserted into a built-in pipe 40 that is buried in the walls so that the suspension rod can be pulled out when needed. A hook 37 is provided at the end of the front rod 38, and the wire 4 is connected to this hook 37.

As has been described above, the emergency evacuation apparatus of this invention has the following structure. The drum with the hoisting wire wound around it is supported above the cage. The drum is provided with a brake cylinder that is combined to form a single body with the drum to be rotatable together with the drum as one unit. Facing this brake cylinder, the brake lever is provided such that the brake lever is given by the spring the momentum to work in the direction to apply the brake to the brake cylinder. Also, the brake release pedal causes, when stepped on, the brake lever to turn in the direction to release the brake. Therefore, when a person in the cage simply operates the release pedal, the whole body of the cage goes down by its overall weight. This makes it possible for a person, evacuee, to escape from a high place to a safe and lower place quickly and easily without much work. Accordingly, even a physically handicapped person such as a sick, injured or elderly person, can readily evacuate to a safe place. Furthermore, since the person can always keep his feet in touch with floor of the cage, he can use this evacuation apparatus without suffering feelings of insecurity.

I claim:

1. An emergency evacuation apparatus comprising:
a cage;
a drum with a hoisting wire wound around it, the drum being rotatably provided above the cage;
a brake cylinder installed in the drum in a manner to rotate together with the drum as a single unit;
a brake lever for applying a brake to the brake cylinder, the brake lever being disposed to face the brake cylinder;
a brake release lever that causes the brake lever to turn in a direction to release the brake applied to the brake cylinder;
a suspension frame connected to the cage by means of pins in a manner to freely swing;
an interlocking lever for interlocking the brake lever with the brake release lever, the interlocking lever being at its center held pivotally by the suspension frame and being rotated by the brake release lever in an opposite direction than it would be by a swinging direction of the cage when an evacuee enters, the brake release lever is operated to release the brake applied to the cylinder;
a push rod fixed at one end of the interlocking lever, the push rod pushing the brake lever in the direction to release the brake;
wherein the brake release lever includes a pedal which is pivotably attached to and provided at the bottom of the cage, the brake release lever being at one side of the cage with said pins as demarcation points, and the brake release lever is connected to the interlocking lever such that the brake release lever turns the interlocking lever in a direction for the brake to be released; and
a door is provided on the other side of the cage with said pins as said demarcation points.

2. An emergency evacuation apparatus according to claim 1, wherein said pedal which is located at the bottom inside the cage is operated by stepping on it with a foot.

3. An emergency evacuation apparatus according to claim 1, wherein the cage is designed to be foldable along the width between a front and back of the cage.

4. An emergency evacuation apparatus comprising:
a cage being designed to be foldable along the width between a front and back of the cage, the cage being in the form of a rectangular box with its top open and comprising:
side walls provided on both sides of the cage, the side walls being formed of a plurality of cross pieces by pivotably attaching them in pairs with the pivot points aligned in a vertical row and each cross piece end pivotably attached adjacent a back wall and a door which are provided at the back and front of the cage, respectively, so that each pair of cross pieces can be folded into an inverted V-shape;
and a floor board foldable about an axis parallel to said pivot points and disposed in said vertical row into an inverted V-shape;
a drum with a hoisting wire wound around it, the drum being rotatably provided and operably connected above the cage;
a brake cylinder installed in the drum in a manner to rotate together with the drum as a single unit;
a brake lever for applying a brake to the brake cylinder, the brake lever being disposed to face the brake cylinder; and
a brake release lever inter- connected with the brake lever such that it causes the brake lever to turn in a direction to release the brake applied to the brake cylinder when the break release lever is actuated.

5. An emergency evacuation apparatus according to claim 4, the apparatus further comprising:
a pair of coupling rods disposed on each of said side walls, the coupling rods being in an inverted V-shape, and lower ends of the coupling rods being pivotally fixed to upper portions of the front and back of the cage adjacent each corner thereof; and
a fixing base coupled to upper ends of each of the coupling rod pairs.

* * * * *